US005259315A

United States Patent [19]

Rekas

[11] Patent Number: 5,259,315

[45] Date of Patent: Nov. 9, 1993

[54] NON-ELECTRICAL DETONATOR

[75] Inventor: Peter Rekas, Wiener Neudorf, Austria

[73] Assignee: Schaffler & Co. Gesellschaft M.B.H., Austria

[21] Appl. No.: 898,134

[22] Filed: Jun. 15, 1992

[30] Foreign Application Priority Data

Jun. 13, 1991 [AT] Austria ..... 1190/91

[51] Int. Cl.[5] ..... C06C 5/06

[52] U.S. Cl. ..... 102/275.5; 102/275.9; 102/275.11; 102/275.8; 102/204

[58] Field of Search ..... 102/275.1-275.12, 102/204, 322

[56] References Cited

U.S. PATENT DOCUMENTS 1,198,644 9/1916 Loomis ..... 102/275.5
2,857,845 10/1958 Seavey ..... 102/275.2
3,791,256 2/1974 Curtis et al. ..... 89/185
4,493,263 1/1985 Carabateas ..... 102/483
4,809,610 3/1989 Florin ..... 102/275.12

FOREIGN PATENT DOCUMENTS 253955 1/1988 European Pat. Off. .
13845 of 1903 United Kingdom ..... 102/275.9

*Primary Examiner*—Stephen M. Johnson
*Attorney, Agent, or Firm*—Hill, Steadman & Simpson

[57] ABSTRACT

A non-electrical detonator including an elongate sleeve with a main charge, an initial charge, a delay composition and a gas chamber therein, a subassembly for firing the delay composition including a percussion cap engageable by a double ended striking pin which can be inserted in either direction within a tube, and a fuse held with an elastic plug to operate the striking pin.

16 Claims, 3 Drawing Sheets

NON-ELECTRICAL DETONATOR

BACKGROUND OF THE INVENTION

The invention relates to non-electrical detonators operated by a fuse driving a striking pin to fire a percussion cap.

More particularly, the invention relates to a detonator assembly which contains a main charge, initial charge, and a delay element. The charges are fired by a percussion cap which is in a unique assembly operated by a double ended striking pin movable against a compressible spherical body and operated by the pressure of the fuse.

A detonator of this type is disclosed in European Patent EP-A1 0253955, particularly in FIG. 4 of the patent. In this structure if the fuse or the primer tube, that is, the chemical substance contained therein is ignited, the resultant pressure wave propagates at high velocity and propels the striking pin against the percussion cap whereupon the igniter is detonated. The striking pin in this arrangement is guided partially in the fuse and partially in the percussion cap retainer.

However, this arrangement has proven disadvantageous in certain aspects such as when the detonator is assembled and crimped, which is accomplished by insertion of the fuse in the sleeve employed in an interposed elastic plug and subsequent deformation of the sleeve, a fuse section may then also become restricted resulting in inhibition of the mobility of the striking pin. This, of course, can make the detonator become ineffective. Moreover, the effective surface area of the striking pin upon which the gas pressure of the fuse can act is limited to the clear cross section of the fuse.

FEATURES OF THE INVENTION

It is an object of the present invention to eliminate the disadvantages discussed above with respect to the alluded to prior art device.

A further object of the invention is to provide an improved detonator which has features of improved assembly eliminating the possibility of misassembly which can occur in structures heretofore available.

A further object of the invention is to provide a simplified overall detonator construction which is more reliable in operation than arrangements heretofore used.

In accordance with a feature of the invention, disadvantages of the arrangement above described in particular is achieved in that a retainer is provided for a striking pin which is essentially of hollow cylindrical shape and the entire striking pin is located in and guided by the retainer.

With the striking pin now entirely located in and guided by the hollow cylindrical retainer, there is no longer any danger that the mobility of the striking pin will be adversely affected by the crimping of the sleeve during detonator manufacture. Moreover, the entire cross section of the striking pin is now exposed to the pressure wave of the fuse thus giving maximum impact force to the striking pin.

A further disadvantage of the detonator described in the above mentioned European patent lies in the fact that the striking pin may hit the percussion cap if the detonator is dropped thus causing unintentional detonation. With the features of the present invention, this is avoided in that there is an elastic body located between the percussion cap and the striking pin. This elastic body has to be penetrated by the striking pin for detonation to occur. This elastic body retains the striking pin a safe distance from the percussion cap until the striking pin is intentionally propelled forward by the shock wave of the fuse. As a result, accidental and unintentional firing of the detonator is prevented with reliability.

In the case of heretofore known non-electrical detonators, it has been the practice that the percussion cap is merely inserted in the retainer. This has meant that the position of the percussion cap is not precisely defined. This has led to differing initial clearances between the striking pin and the percussion cap. This causes a variance in firing behavior from detonator to detonator.

In order to avoid this disadvantage, it is recommendable and is the case in the present invention to secure the percussion cap in the retainer by means of a supporting tube which surrounds the striking pin. Maximum clearance between the striking pin and the percussion cap is thus clearly defined.

The normal design employed for striking pins in non-electrical detonators is such that at one end there is located the surface which reacts to gas pressure. At the other end of the striking pin is located a projection which penetrates the percussion cap. When assembling the detonator, it is necessary to insure that the striking pin is positioned the correct way around, that is, that the striking pin is always assembled in the same axial direction. The additional time and expense associated with this orientation can be avoided by the present arrangement. Also, the present arrangement will avoid misassembly which can result in inoperativeness of the detonator. This is accomplished in the present arrangement by making the striking pin of symmetrical design so that each axial end is the same. With such a design, either end of the striking pin can be inserted first so there is no longer any need to insure that it is being installed in the correct axial direction. In the present arrangement, the entire unit provides a compact overall sleeve which is capable of rapid assembly and capable of simplified completion of manufacture.

Other advantages, features and details will become more apparent with the teaching of the principles of the invention in connection with the disclosure of the specification, claims and drawings, in which:

DESCRIPTION OF THE PREFERRED EMBODIMENT

Figure 1:
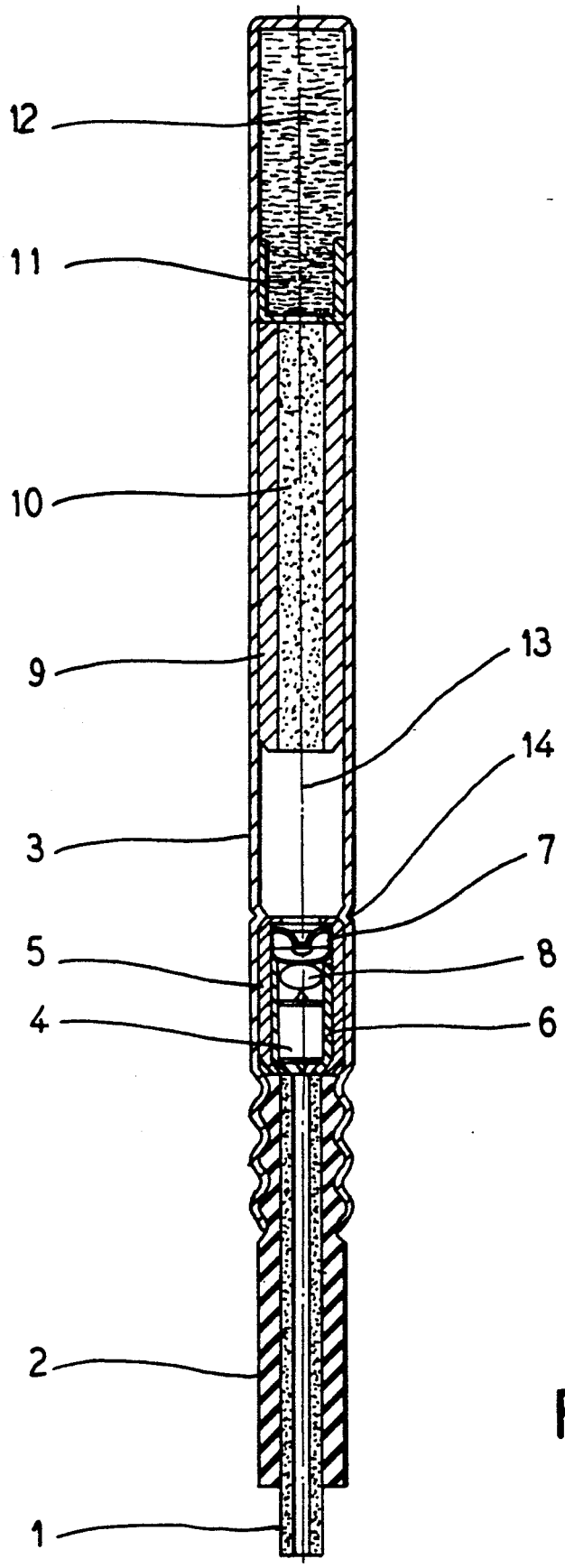
FIG. 1 is a vertical sectional view taken through the axis of a detonator constructed and operating in accordance with the principles of the present invention.

The non-electrical detonator shown in its entirety in FIG. 1 includes a sleeve 3 which is closed at one end, shown in the drawing as the upper end. At the other open end, is inserted a fuse or a primer tube 1. This fuse is fixed in the sleeve open end by being held within an elastic plug and the sleeve is deformed against the elastic plug by annular indentations with the sleeve being formed of a light weight metal or plastic.

Figure 2:
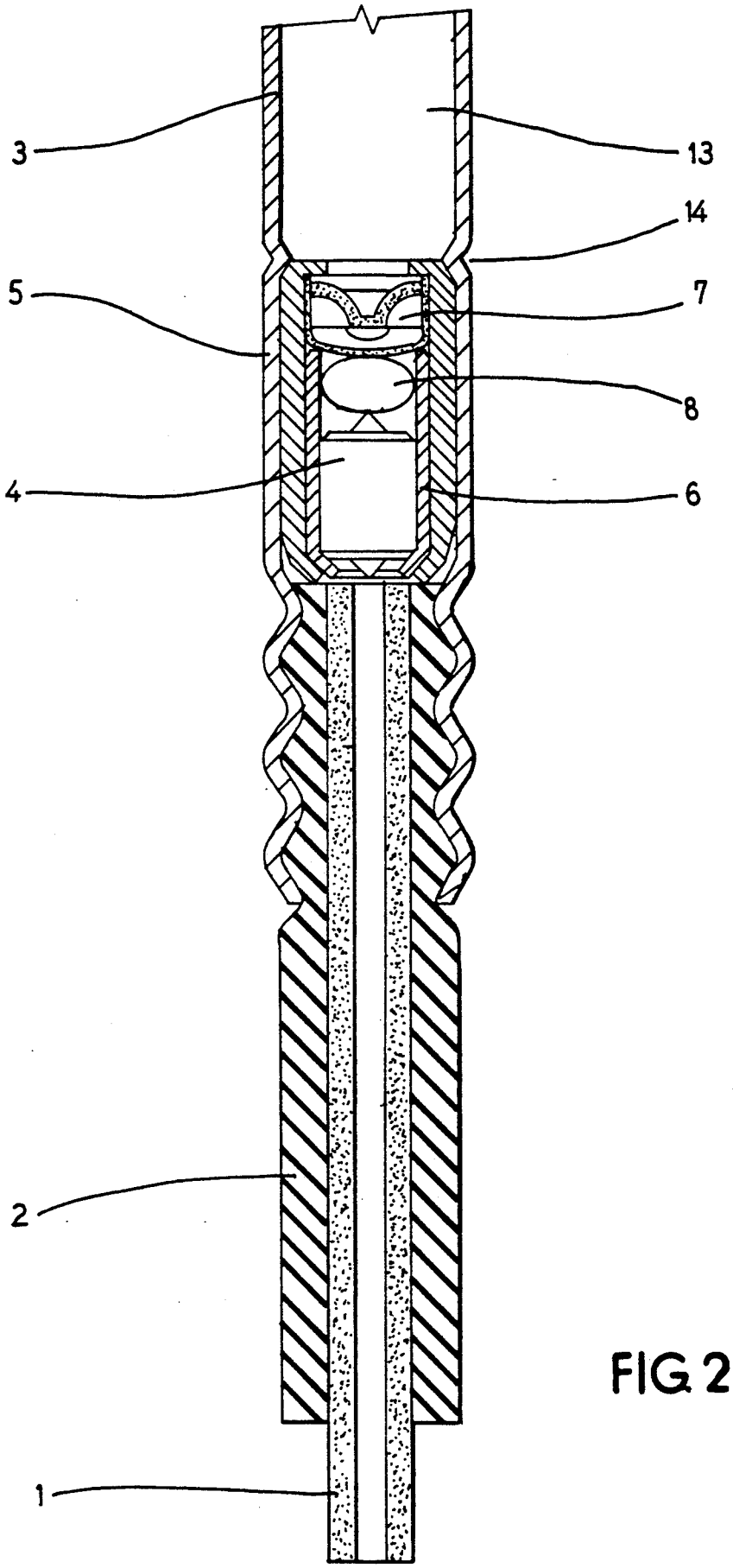
FIG. 2 is an enlarged view of FIG. 1 but showing only the lower portion of the detonator in greater detail.
Figure 3:
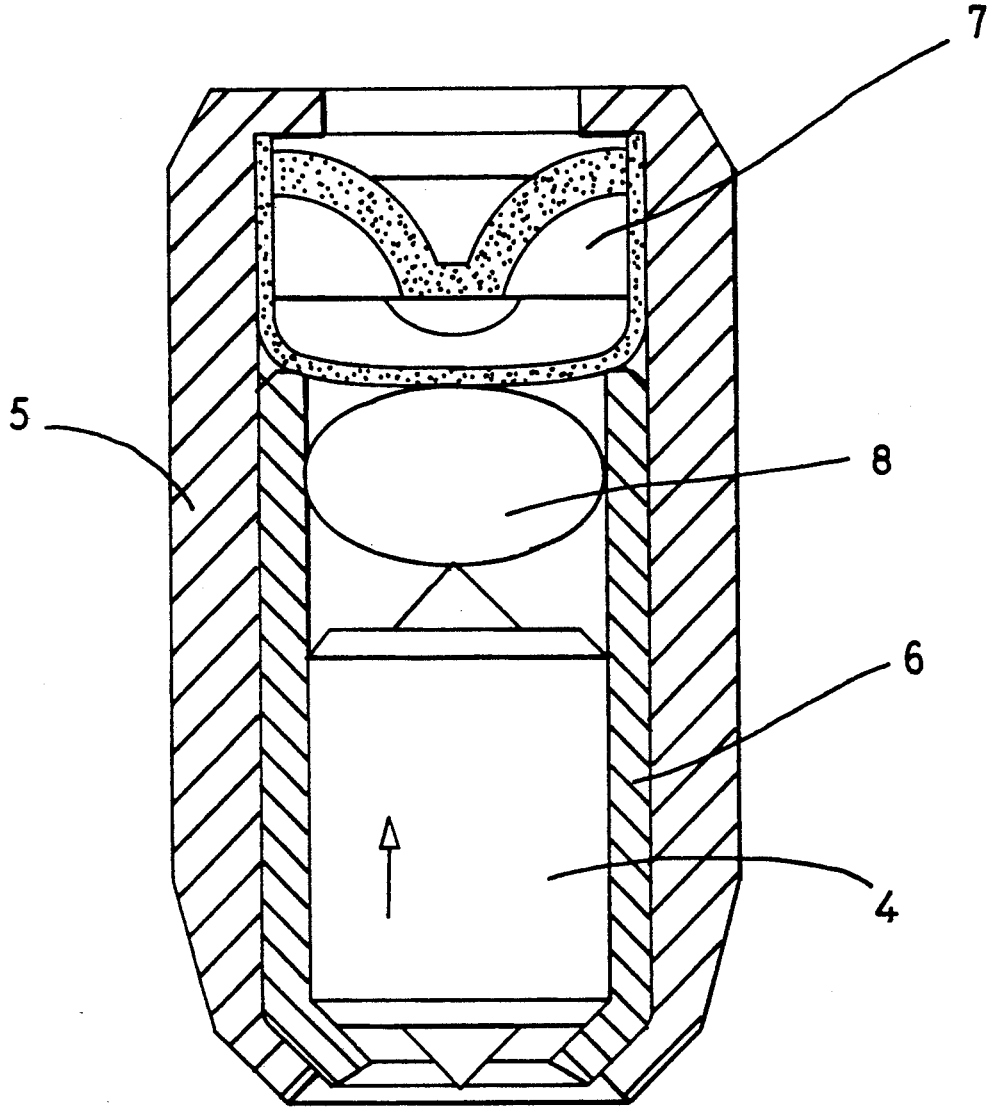
FIG. 3 is an enlarged detailed section through the axis of the portion of the detonator containing the firing pin and its associated mechanism.

Also inserted in the sleeve is a firing pin assembly which is shown in detail in FIG. 3, and as shown, it is held within the sleeve in FIG. 2.

A striking pin is shown at 4 capable of free axial movement within a hollow cylindrical retainer 5. Actually, the retainer holds a hollow cylindrical tube 6 within which the firing pin slides as indicated by the arrow in FIG. 3 which indicates the direction in which the striking pin must move to fire the percussion cap.

Within the cylindrical retainer 5 at the upper end thereof and held therein by a slight flange at the upper end of the retainer is a percussion cap 7. The tube 6 within which the striking pin slides presses up axially against the percussion cap to hold it in position within the hollow retainer 5.

The striking pin 4 is designed such that is has a projecting pin at either end with the projecting pin having the capabilities of firing the percussion cap. This has the advantage that in assembly, the striking pin 4 can be installed in either axial direction and the assembler need not check to be sure that the striking pin is installed in one axial direction only.

Between the striking pin 4 and the percussion cap 7 is an elastic generally spherical body 8 which acts as a compression spring. This elastic body which can be formed of a plastic material, firmly holds the striking pin in its initial position at the base of the tube 6 and separates the striking pin from the percussion cap 7.

The retainer 5 and the supporting tube 6 can be assembled in a common operation. The supporting tube 6 has a flanged-in or lower reduced opening so that the striking pin can be first dropped into the upper end and the spherical body placed in thereafter. The supporting tube then can be slid up into the hollow retainer 5 and the hollow retainer be crimped inwardly or reduced at its lower end. This crimping spaces the striking pin upwardly from the lower end of the retainer and as a result, the fuse 1 does not come in contact with the striking pin, but a space remains as shown in FIG. 2. In the sleeve 3, the position of the retainer 5 is fixed by an annular restriction 14 which positions the top end of the retainer, and the crimping which holds the elastic plug in place holds the lower end of the retainer. The retainer, thus, is in a tight interference fit within the sleeve, and if the sleeve is formed of a metal, the parts are all held together and the sealing seals all of the chemical constituents of the explosive charges and other materials within the sleeve.

In the space between the retainer 5 and the closed end of the sleeve 3 is an igniter which has an initial charge 11 and a main charge 12. Below that is a delay composition 10 which is contained in a delay element 9. A gas chamber 13 provides a free space between the percussion cap and the delay element.

In operation when the fuse 1 is ignited, the pneumatic energy of the fuse acts like a shock wave on the striking pin 4 and this is propelled in the upward direction indicated by the arrow in FIG. 3. The forcible upward movement of the striking pin overcomes the resistance of the elastic body 8 and detonates the percussion cap 7. In the ensuing sequence, this ignites the delay composition 10 in the delay element 9. The gas chamber in which the combustion gases gather remains closed and this results in a high degree of accuracy with respect to the delay time. After the pyrotechnic delay composition 10 has been burned through, the flame reaches the initial charge 11 which as a sequence continues, ignites the main charge 12 whereupon the detonator explodes.

Thus, it will be seen that the firing pin assembly arrangement is such that inadvertent dropping of the sleeve will not accidentally create a mechanical pressure on the striking pin to inadvertently fire the detonator. Also, the arrangement provides a rigid reliable-secure detonator assembly which is reliable in time of operation and compact for ease of handling.

I claim as my invention:

1. A non-electrical detonator comprising in combination:
   - an elongate sleeve closed at one end with a combustible fuse at the other end;
   - an explosive charge within the sleeve at the closed end;
   - a delay composition within the sleeve adjacent the charge;
   - a percussion cap within a hollow cylindrical retainer within the sleeve between the fuse and the delay composition;
   - and a striking pin between the fuse and percussion cap within the cylindrical retainer and guided thereby movable to engage and fire the percussion cap with ignition of the fuse so that movement of the striking pin generated by combustion of the fuse will fire the percussion cap to cause the cap to ignite the delay composition to thereby fire said charge;
   - said striking pin being uniformly shaped and sized at opposite ends accommodating insertion within the retainer in either axial direction.

2. A non-electrical detonator constructed in accordance with claim 1:
   - and including an elastic body positioned between the striking pin and the percussion cap and penetrable by the striking pin with movement thereof due to ignition of the fuse.

3. A non-electrical detonator constructed in accordance with claim 1:
   - including a supporting tube held within the retainer and surrounding the striking pin retaining the pin slidably therein.

4. A non-electrical detonator constructed in accordance with claim 1:
   - wherein the striking pin has a point at each axial end thereof.

5. A non-electrical detonator constructed in accordance with claim 1:
   - including a supporting tube within the retainer slidably supporting the striking pin, said sleeve crimped inwardly along the fuse for retaining the striking thereby retaining the fuse in position within the sleeve and holding the retainer axially in place within the sleeve.

6. A non-electrical detonator constructed in accordance with claim 5:
   - wherein the cylindrical retainer is crimped inwardly at an end for retaining the tube.

7. A firing pin assembly for a non-electrical detonator for being located between a fuse and a charge within an elongate tube comprising in combination:
   - a hollow cylindrical retainer;
   - a cylindrical supporting tube within the retainer;
   - a cylindrical striking pin slidably mounted within the tube having a striking point;
   - and a percussion cap within the retainer positioned to be engaged by said point for firing;
   - said striking pin being uniformly shaped and sized at each end with a striking point at each end so that it may be assembled into the tube in either axial direction.

8. A firing pin assembly for a non-electrical detonator for being located between a fuse and a charge within an elongate tube constructed in accordance with claim 7:

including a compression body positioned between the percussion cap and the striking pin.

9. A firing pin assembly for a non-electrical detonator for being located between a fuse and a charge within an elongate tube constructed in accordance with claim 8:

wherein the compression body is of a compressible collapsible material.

10. A firing pin assembly for a non-electrical detonator for being located between a fuse and a charge within an elongate tube constructed in accordance with claim 8:

wherein said compression body have a general spherical shaped.

11. A firing pin assembly for a non-electrical detonator for being located between a fuse and a charge within an elongate tube constructed in accordance with claim 7:

wherein said percussion cap is held within the cylindrical retainer and the supporting tube axially abuts the cap supporting said cap in position axially.

12. A firing pin assembly for a non-electrical detonator for being located between a fuse and a charge within an elongate tube constructed in accordance with claim 7:

wherein said tube is crimped inwardly at one end holding the striking pin within the tube.

13. A firing pin assembly for a non-electrical detonator for being located between a fuse and a charge within an elongate tube constructed in accordance with claim 7:

wherein the retainer is crimped at one end holding the supporting tube within the retainer.

14. A firing pin assembly for a non-electrical detonator comprising in combination:

an elongate sleeve closed at one end with a fuse at the other end;

an elastic plug surrounding said fuse and held axially by compressed areas of the sleeve;

a main charge at the closed end of the sleeve;

an initial charge adjacent the main charge at the closed end;

a delay composition within the sleeve adjacent the initial charge;

a gas chamber within the sleeve positioned adjacent the delay composition;

a hollow cylindrical retainer within the tube between the fuse and gas chamber and held in position by depressed areas of the sleeve;

a tube held within the cylindrical retainer having a cylindrical hollow interior therein;

a cylindrical striking pin within the tube;

a percussion cap held within the retainer;

and a compressible body between the striking pin and the percussion cap whereby operation of the fuse will cause movement of the striking pin to operate the percussion cap.

15. A firing pin assembly for a non-electrical detonator constructed in accordance with claim 14:

wherein the striking pin has a point at each end and is shaped and sized uniformly at each end to be insertable within the tube in either direction.

16. A firing pin assembly for a non-electrical detonator constructed in accordance with claim 14:

wherein the tube is crimped to hold the striking pin within the tube and the retainer is crimped to hold the tube within the retainer.

* * * * *